US011608993B2

(12) United States Patent
Liang et al.

(10) Patent No.: US 11,608,993 B2
(45) Date of Patent: Mar. 21, 2023

(54) SEALING DEVICE FOR WINDOW AIR CONDITIONER AND WINDOW AIR CONDITIONER HAVING THE SAME

(71) Applicants: GD MIDEA AIR-CONDITIONING EQUIPMENT CO., LTD., Foshan (CN); MIDEA GROUP CO., LTD., Foshan (CN)

(72) Inventors: Jiawen Liang, Foshan (CN); Ali Zhao, Foshan (CN); Zhisheng Lei, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 783 days.

(21) Appl. No.: 16/498,286

(22) PCT Filed: Aug. 27, 2019

(86) PCT No.: PCT/CN2019/102824
§ 371 (c)(1),
(2) Date: Sep. 26, 2019

(87) PCT Pub. No.: WO2021/026966
PCT Pub. Date: Feb. 18, 2021

(65) Prior Publication Data

US 2021/0355750 A1 Nov. 18, 2021

(30) Foreign Application Priority Data

Aug. 9, 2019 (CN) ..... 201921293834.0

(51) Int. Cl.
*F24F 1/031* (2019.01)
*E06B 7/18* (2006.01)
(Continued)

(52) U.S. Cl.
CPC ..... *F24F 1/031* (2019.02); *E06B 7/03* (2013.01); *E06B 7/18* (2013.01); *F24F 13/32* (2013.01)

(58) Field of Classification Search
CPC .. F24F 1/027; F24F 1/031; F24F 13/20; F24F 13/32; E06B 7/18; E06B 7/02; E06B 7/03; E06B 3/5063
(Continued)

(56) References Cited

U.S. PATENT DOCUMENTS 2,604,763 A * 7/1952 Lipman ..... F24F 1/027 62/262
2,925,026 A * 2/1960 Schuster ..... F24F 1/04 454/203
(Continued)

FOREIGN PATENT DOCUMENTS

CN 108870565 A * 11/2018 ..... F24F 1/027
CN 109184456 A 1/2019
(Continued)

OTHER PUBLICATIONS

World Intellectual Property Organization (WIPO) International Search Report for PCT/CN2019/102824 dated Apr. 26, 2020 11 Pages.

*Primary Examiner* — Edelmira Bosques
*Assistant Examiner* — Frances F. Hamilton
(74) *Attorney, Agent, or Firm* — Anova Law Group PLLC

(57) ABSTRACT

A sealing device for a window air conditioner includes a first adjusting member and a second adjusting member. The second adjusting member includes a sliding space. The first adjusting member extends into the sliding space. The second adjusting member is slidable relative to the first adjusting member. One of an outer peripheral wall of the first adjusting member and an inner wall of the second adjusting member includes a plurality of buckles spaced apart from
(Continued)

one another along a moving direction of the second adjusting member. Another one of the outer peripheral wall of the first adjusting member and the inner wall of the second adjusting member includes an elastic protruding portion in switchable contact fit with the plurality of buckles during movement of the second adjusting member.

18 Claims, 16 Drawing Sheets

(51) Int. Cl.
*F24F 13/32* (2006.01)
*E06B 7/03* (2006.01)

(58) Field of Classification Search
USPC ..... 454/201, 203, 204
See application file for complete search history.

(56) References Cited

U.S. PATENT DOCUMENTS 3,271,972 A * 9/1966 Knight ..... F24F 1/04 62/262
3,392,546 A * 7/1968 Reed ..... F24F 7/013 62/262
3,861,283 A * 1/1975 Shaner ..... F24F 1/04 62/262
4,453,456 A * 6/1984 Szkudlarek ..... E06B 7/02 160/91
4,462,625 A * 7/1984 Barnhill ..... E05C 19/003 292/259 R
4,583,715 A * 4/1986 Wright ..... E06B 9/04 160/226
4,680,838 A * 7/1987 Astl ..... F16L 37/00 24/442
4,817,334 A * 4/1989 Badger ..... E06B 9/01 49/55
4,838,151 A * 6/1989 Shin-Chin ..... F24F 7/013 454/200
5,167,131 A * 12/1992 Karkhanis ..... F24F 1/027 62/262
5,582,025 A * 12/1996 Dubin ..... F24F 13/32 62/262
5,660,605 A 8/1997 Chan et al.
8,371,913 B1 2/2013 Taylor
10,508,818 B2 * 12/2019 Xu ..... F24F 1/027
10,689,901 B2 * 6/2020 O'Leary ..... H02G 3/083
11,441,791 B2 * 9/2022 Lei ..... F24F 13/32
2003/0097854 A1 * 5/2003 Cur ..... F24F 1/027 62/262
2007/0068185 A1 * 3/2007 Thompson ..... F24F 1/027 62/262
2007/0137237 A1 * 6/2007 Rais ..... F24F 1/027 62/262
2017/0191679 A1 * 7/2017 Xu ..... F24F 13/32
2017/0191763 A1 * 7/2017 Xu ..... F24F 1/027
2018/0031018 A1 * 2/2018 Muirhead ..... F16B 7/14
2018/0291674 A1 * 10/2018 Dintheer ..... E06B 7/18
2019/0212028 A1 * 7/2019 Zemborain ..... F24F 13/18
2020/0248911 A1 * 8/2020 Lei ..... F24F 13/32
2021/0199332 A1 * 7/2021 Xing ..... F24F 13/22
2021/0207819 A1 * 7/2021 Zhang ..... F24F 13/32
2021/0356145 A1 * 11/2021 Lei ..... F24F 1/0323

FOREIGN PATENT DOCUMENTS

CN 208671286 U 3/2019
CN 109724168 A 5/2019
CN 109724170 A 5/2019
CN 109724171 A 5/2019
CN 109724172 A 5/2019
CN 109974128 A 7/2019
CN 209689079 U 11/2019
CN 209689081 U 11/2019
CN 209706234 U 11/2019
CN 209763324 U 12/2019
CN 209763326 U 12/2019
CN 209857234 U 12/2019
CN 209944569 U 1/2020
CN 210118878 U 2/2020
CN 216199580 U * 4/2022
DE 4404117 A1 * 8/1995 ..... F16B 37/0842
DE 10020833 A1 * 6/2001 ..... F16B 19/002
DE 10311574 A1 * 9/2004 ..... B62D 43/10
EP 1719923 A1 * 11/2006 ..... A47B 91/02
KR 20110002841 U * 9/2009
KR 20200007224 A * 1/2020
WO WO-2020037956 A1 * 2/2020 ..... F24F 1/027

* cited by examiner

C-C

SEALING DEVICE FOR WINDOW AIR CONDITIONER AND WINDOW AIR CONDITIONER HAVING THE SAME

CROSS-REFERENCE TO RELATED APPLICATION APPLICATIONS

This application is a National Stage Entry under 35 U.S.C. § 371 of International Application No. PCT/CN2019/102824, filed on Aug. 27, 2019, which is based on and claims priority to Chinese Patent Application Serial No. 201921293834.0, filed on Aug. 9, 2019, the entire contents of both of which are incorporated herein by reference.

FIELD

The present disclosure relates to a field of air conditioning technology, and particularly, to a sealing device for a window air conditioner, and a window air conditioner having the same.

BACKGROUND

In a window air conditioner of the related art, a sealing device of the window air conditioner has a single size and cannot match windows of various dimensions. After the window air conditioner is installed to a window, the sealing length of the sealing device is fixed and cannot be adjusted for different dimensions of windows. Consequently, the applicable scope of the window air conditioner is affected, and the operation is inconvenient.

SUMMARY

The present disclosure aims to at least solve one of the technical problems existing in the related art. To this end, the present disclosure provides a sealing device for a window air conditioner, and the sealing device has a variable sealing length, and is convenient to use and easy to operate.

The present disclosure further provides a window air conditioner having the above sealing device.

For the sealing device according to a first aspect of the present disclosure, the window air conditioner is installed in a window opening of a wall, a movable window sash is provided in the window opening, a casing of the window air conditioner is provided with a receiving groove, and the window sash is moved to the receiving groove. The sealing device is provided corresponding to the receiving groove, and one end of the sealing device is connected to the casing while the other end of the sealing device is used to seal, at an outer side of the casing, a gap between the window opening and the window sash. The sealing device includes: a first adjusting member; and a second adjusting member including a first sliding space therein. The first adjusting member extends into the first sliding space. The second adjusting member is slidable relative to the first adjusting member. One of an outer peripheral wall of the first adjusting member and an inner wall of the second adjusting member is provided with a first elastic protruding portion, while the other one of the outer peripheral wall of the first adjusting member and the inner wall of the second adjusting member is provided with a plurality of first buckles, the plurality of first buckles being spaced apart along a moving direction of the second adjusting member. The first elastic protruding portion is in switchable contact fit with the plurality of first buckles during the movement of the second adjusting member.

With the sealing device according to embodiments of the present disclosure, the user can directly pull the second adjusting member to adjust the sealing length of the sealing device. Meanwhile, during the movement of the second adjusting member, the first elastic protruding portion is in switchable contact fit with the plurality of first buckles, in which case the user feels a slight jerk and has a strong sense of operation. When the second adjusting member is moved to a position desired by the user, the first elastic protruding portion is fitted with the corresponding first buckle to achieve fixation of the second adjusting member, thereby facilitating adjustment to the sealing length of the sealing device, and simplifying the operation.

In some embodiments of the present disclosure, the sealing device further includes: a third adjusting member including a second sliding space therein. The second adjusting member is slidable relative to the third adjusting member and extends into the second sliding space. One of an inner wall of the third adjusting member and an outer peripheral wall of the second adjusting member is provided with a second elastic protruding portion, while the other one of the inner wall of the third adjusting member and the outer peripheral wall of the second adjusting member is provided with a plurality of second buckles, the plurality of second buckles being spaced apart along a sliding direction of the third adjusting member. The second elastic protruding portion is in switchable contact fit with the plurality of second buckles during the relative movement of the third adjusting member and the second adjusting member.

In some embodiments of the present disclosure, the plurality of first buckles and the second elastic protruding portion are all provided at the second adjusting member.

In some embodiments of the present disclosure, the outer peripheral wall of the second adjusting member is provided with a first recess, and the second elastic protruding portion is provided in the first recess.

In some embodiments of the present disclosure, a part of the second adjusting member is recessed towards the first adjusting member to form the first recess, and the second elastic protruding portion is provided at a bottom wall of the part of the second adjusting member.

In some embodiments of the present disclosure, the outer peripheral wall of the first adjusting member is provided with a second recess, and the first elastic protruding portion is provided in the second recess.

In some embodiments of the present disclosure, a part of the first adjusting member is recessed inwards to form the second recess.

In some embodiments of the present disclosure, the inner wall of the second sliding space is provided with an insert that projects into the second adjusting member and the first adjusting member.

In some embodiments of the present disclosure, the third adjusting member is provided with a first sliding groove in a peripheral wall of the third adjusting member, and the second adjusting member is provided with a first sliding protrusion fitted with the first sliding groove.

In some embodiments of the present disclosure, the second adjusting member is provided with a second sliding groove in a peripheral wall of the second adjusting member, and the first adjusting member is provided with a second sliding protrusion fitted with the second sliding groove.

In some embodiments of the present disclosure, the first sliding groove penetrates the third adjusting member in a thickness direction, the second sliding groove penetrates the second adjusting member in the thickness direction, and the first sliding protrusion is disposed around the second sliding groove.

In some embodiments of the present disclosure, the sealing device further includes a rotating bracket fixed at the casing, and the first adjusting member is rotatably provided at the rotating bracket.

In some embodiments of the present disclosure, the sealing device further includes an angle positioning assembly configured to cooperate with the rotating bracket and the first adjusting member to position the first adjusting member when the first adjusting member is rotated to a set angle.

In some embodiments of the present disclosure, the angle positioning assembly includes a positioning protrusion and a plurality of positioning recesses, the positioning protrusion is provided on the first adjusting member, the plurality of positioning recesses are provided in the rotating bracket and arranged in a circular shape, the positioning protrusion can be switchably fitted with the plurality of positioning recesses when the first adjusting member rotates, and the first adjusting member is positioned when the positioning protrusion is fitted with one of the positioning recesses.

A window air conditioner according to a second aspect of the present disclosure is supported in a window opening of a wall, and a movable window sash is provided in the window opening. The window air conditioner includes: a casing provided with a receiving groove, at least a part of the window sash being able to protrude into the receiving groove; and a sealing device configured as the above sealing device, the sealing device being in contact with a bottom end of the window sash, a bottom wall of the window opening, and a side wall of the window opening.

For the window air conditioner according to the embodiments of the present disclosure, by providing the sealing device of the first aspect, the installation of the window air conditioner becomes simple, and the overall performance of the window air conditioner is improved.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of embodiments of the present disclosure will become apparent and more readily appreciated from the following descriptions made with reference the accompanying drawings, in which.

Figure 1:
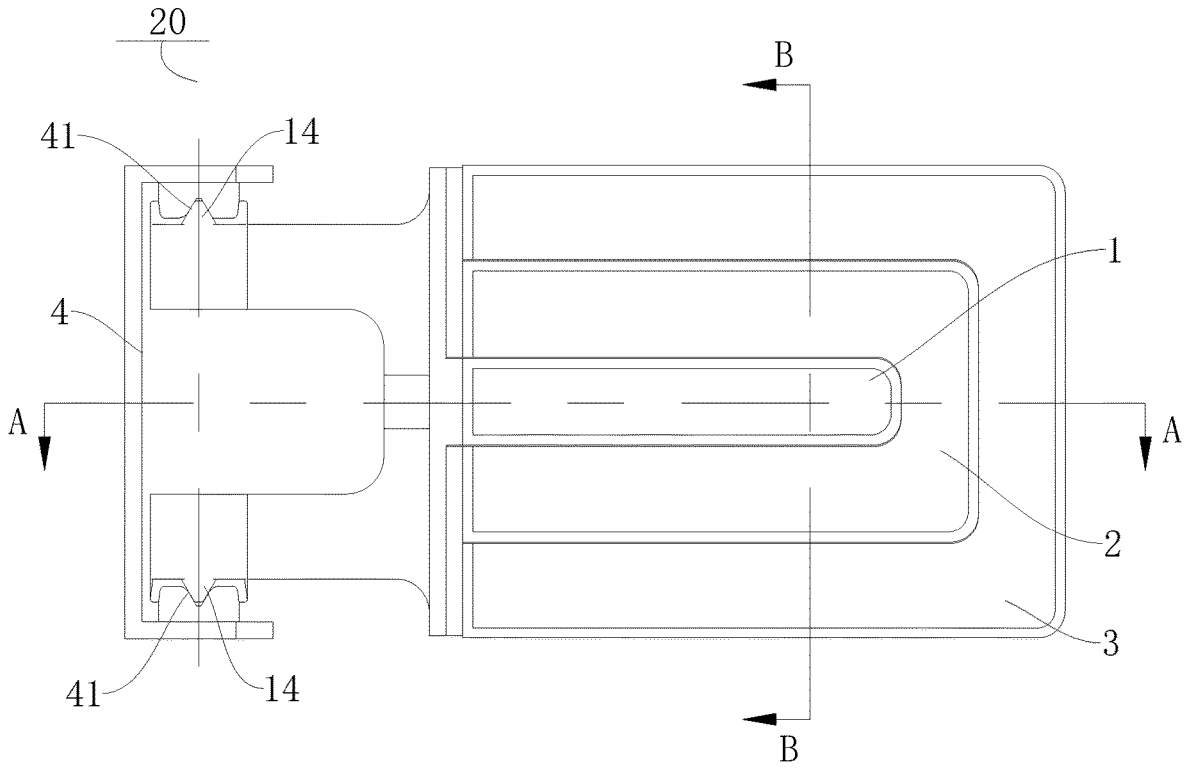
FIG. 1 is a front view of a sealing device for a window air conditioner according to embodiments of the present disclosure, in which state the sealing device has a minimum sealing length.

REFERENCE NUMERALS window air conditioner 100,
casing 10, receiving groove 10*a*,
sealing device 20,
first adjusting member 1, first elastic protruding portion 11, second recess 12, second sliding protrusion 13, pivot shaft 14, first abutting portion 15, fourth sliding protrusion 16,
second adjusting member 2, first sliding space 2*a*, first buckle 21, second elastic protruding portion 22, first recess 23, first sliding protrusion 24, second sliding groove 25, second abutting portion 26, third sliding protrusion 27, fourth sliding groove 28,
third adjusting member 3, second sliding space 3*a*, second buckle 31, insert 32, first sliding groove 33, third abutting portion 34, third sliding groove 35,
rotating bracket 4, pivot hole 41,
angle positioning assembly 5, positioning protrusion 51, positioning recess 52.

DETAILED DESCRIPTION

Embodiments of the present disclosure will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present disclosure, but shall not be construed to limit the present disclosure.

The following description provides many different embodiments or examples for implementing different structures of the present disclosure. In order to simplify the description, components and settings of specific examples are described below. Certainly, they are merely examples and are not intended to limit the present disclosure. In addition, the present disclosure may repeat reference numerals and/or letters in different examples. This repetition is for the purpose of simplicity and clarity, and does not indicate the relationship of various embodiments and/or settings discussed. Moreover, the present disclosure provides examples of various specific processes and materials, but those skilled in the art may recognize the applicability of other processes and/or the use of other materials.

First, a window air conditioner 100 according to embodiments of a second aspect of the present disclosure will be briefly described with reference to the accompanying drawings, and the window air conditioner 100 includes a sealing device 20 according to embodiments of a first aspect of the present disclosure.

The window air conditioner 100 according to embodiments of the present disclosure is supported in a window opening of a wall, and a movable window sash is provided in the window opening. A casing 10 of the window air conditioner 100 is provided with a receiving groove 10*a*, the receiving groove 10*a* has an open top, and the window sash is moved into the receiving groove 10*a*. The sealing device 20 is provided corresponding to the receiving groove 10*a*, for example, provided at a side edge of the receiving groove 10*a*. One end of the sealing device 20 is connected to the casing 10 and can be connected to an internal position of the receiving groove 10*a*, and the other end of the sealing device 20 is used to seal, at an outer side of the casing 10, a gap between the window opening and the window sash.

Specifically, the window sash can be fitted with a bottom of the receiving groove 10*a* in a position of the window sash corresponding to the window air conditioner 100, so as to achieve sealing in the position; the window sash is spaced apart from a bottom wall of the window opening in other positions not corresponding to the window air conditioner 100 (such as positions on one or two sides of the window air conditioner 100), and the sealing device 20 is used to deploy on one or both sides of the window air conditioner 100 to come into contact with a bottom end of the window sash, the bottom wall of the window opening, and a side wall of the window opening, so as to achieve sealing between the window sash and an inner wall of the window opening, that is, achieve sealing between the window sash and a window frame.

Figure 2:
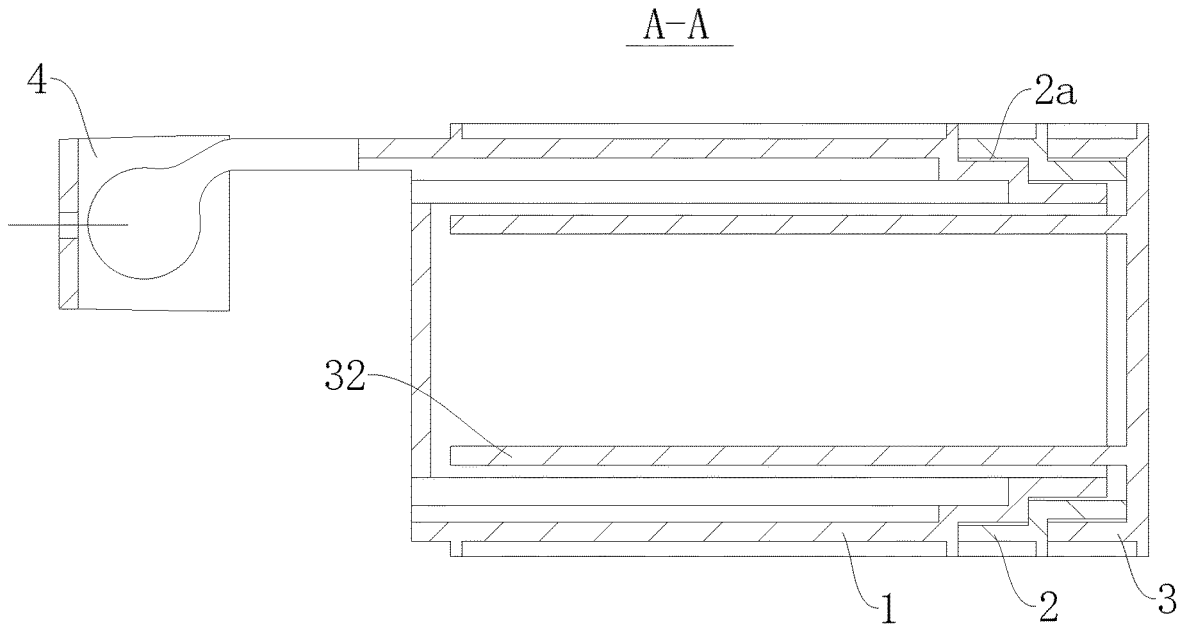
FIG. 2 is a sectional view taken along line A-A in FIG. 1.

As shown in FIGS. 1 and 2, the sealing device 20 for the window air conditioner 100 according to a first aspect of the present disclosure includes a first adjusting member 1 and a second adjusting member 2. For example, the first adjusting member 1 may be connected to the casing 10, or the second adjusting member 2 may be connected to the casing 10.

Referring to FIG. 2, the second adjusting member 2 is provided with a first sliding space 2*a*. The first adjusting member 1 extends into the first sliding space 2*a*, and the second adjusting member 2 is slidable relative to the first adjusting member 1.

One of an outer peripheral wall of the first adjusting member 1 and an inner wall of the second adjusting member 2 is provided with a first elastic protruding portion 11, and the other one of the outer peripheral wall of the first adjusting member 1 and the inner wall of the second adjusting member 2 is provided with a plurality of first buckles 21. In other words, it can be as shown in FIG. 7 that the outer peripheral wall of the first adjusting member 1 is provided with the first elastic protruding portion 11, while the inner wall of the second adjusting member 2 is provided with the plurality of first buckles 21; or it can be as shown in FIG. 8 that the inner wall of the second adjusting member 2 is provided with the first elastic protruding portion 11, while the outer peripheral wall of the first adjusting member 1 is provided with the plurality of first buckles 21.

Figure 3:
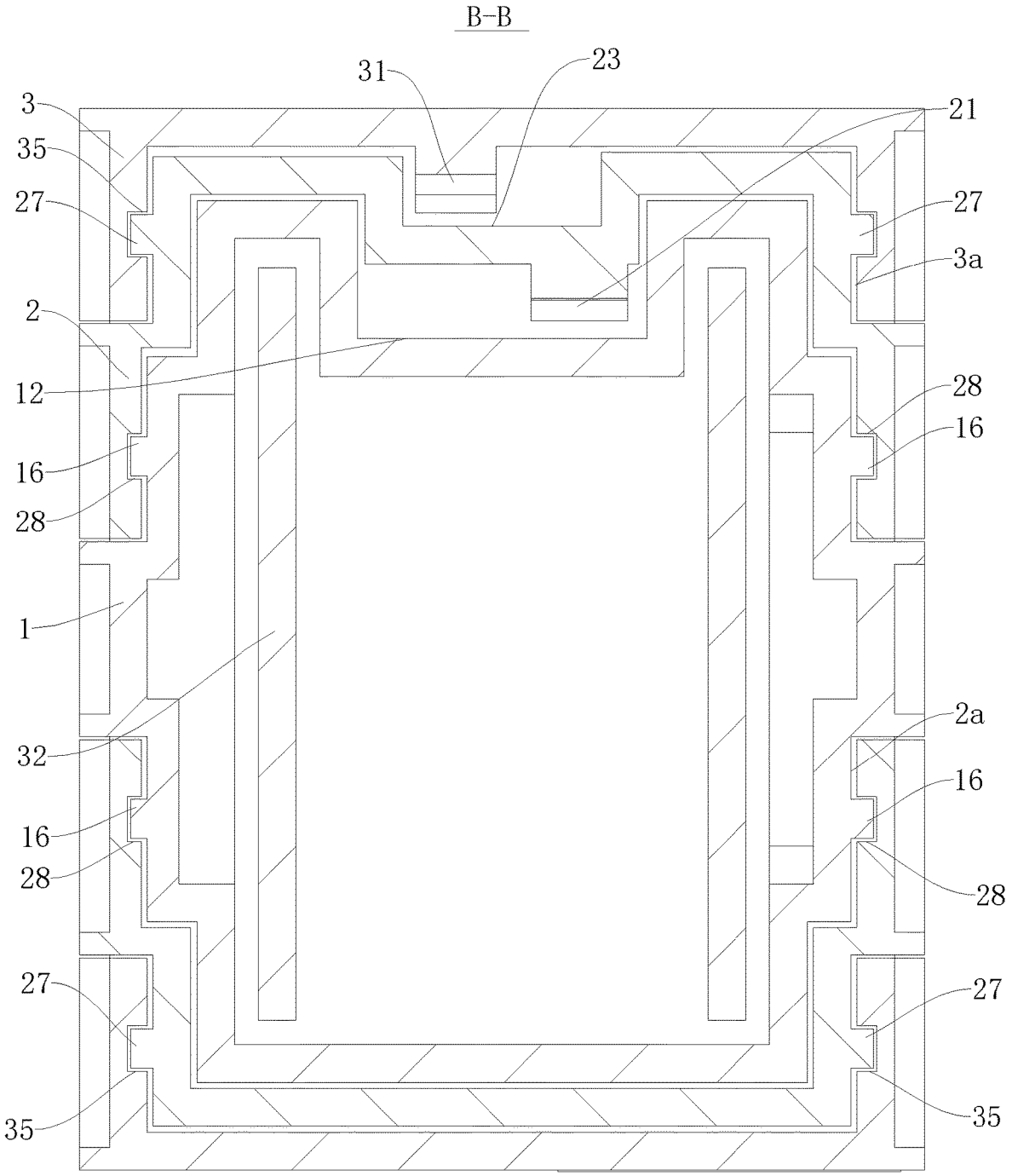
FIG. 3 is a sectional view taken along line B-B in FIG. 1.
Figure 7:
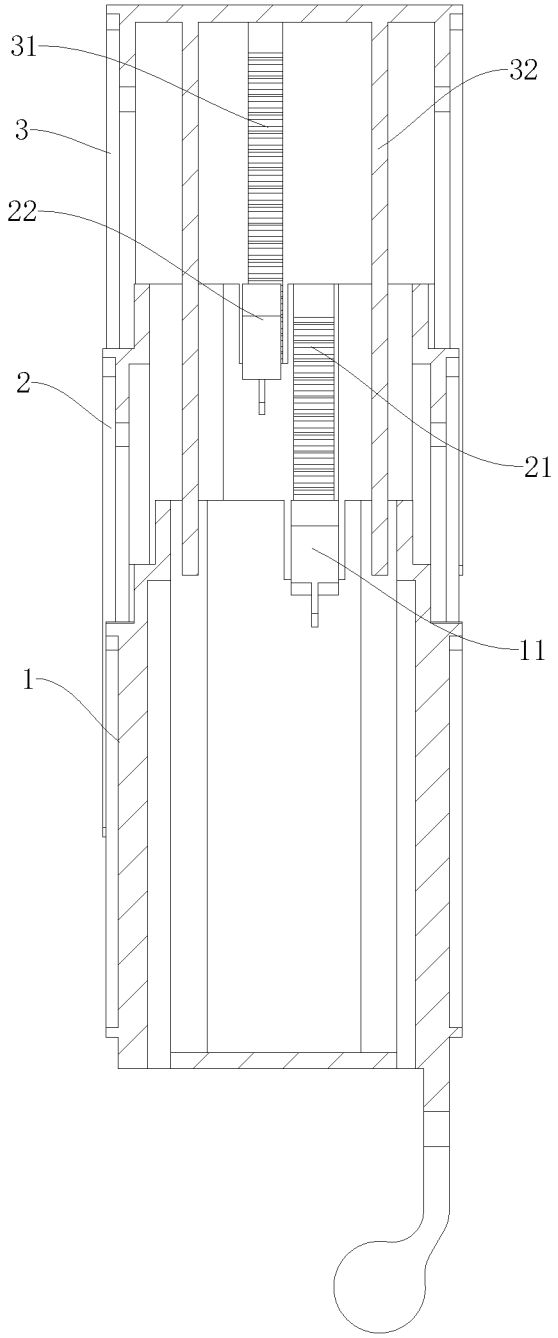
FIG. 7 is a sectional view taken along line C-C in FIG. 6.
Figure 8:
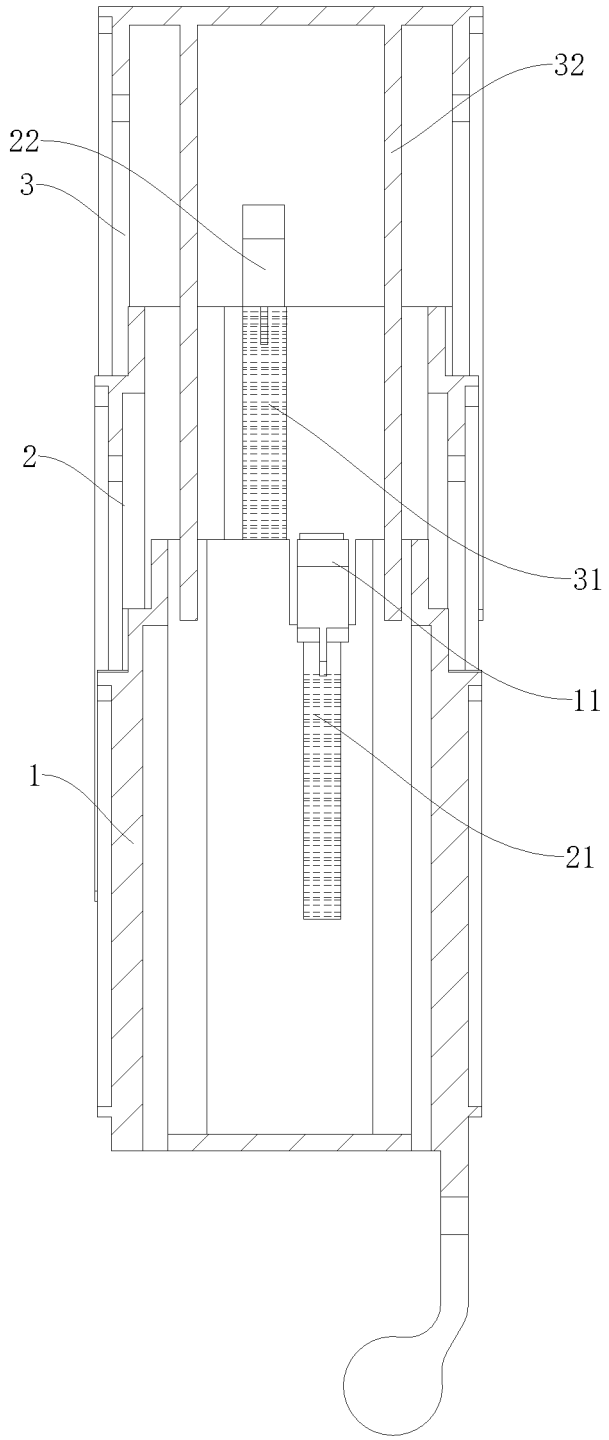
FIG. 8 is a sectional view of a sealing device for a window air conditioner according to some other embodiments of the present disclosure.

Referring to FIG. 3 and FIG. 7, the plurality of first buckles 21 are spaced apart along a moving direction of the second adjusting member 2, and the first elastic protruding portion 11 is in switchable contact fit with the plurality of first buckles 21 during the movement of the second adjusting member 2.

It could be understood that a user can directly pull the second adjusting member 2 to adjust a sealing length of the sealing device 20; meanwhile, during the movement of the second adjusting member 2, the first elastic protruding portion 11 can be deformed and the first elastic protruding portion 11 is in switchable contact fit with the plurality of first buckles 21, in which case the user feels a slight jerk, performs a stepping action, and has a strong sense of operation. When the second adjusting member 2 is moved to a position desired by the user, the first elastic protruding portion 11 is fitted with the corresponding first buckle 21 to achieve fixation of the second adjusting member 2, thereby facilitating adjustment to the sealing length of the sealing device 20, and simplifying the operation.

With the sealing device 20 for the window air conditioner 100 according to the embodiments of the present disclosure, the user can directly pull the second adjusting member 2 to adjust the sealing length of the sealing device 20, and meanwhile, the first elastic protruding portion 11 is in switchable contact fit with the plurality of first buckles 2 during the movement of the second adjusting member 2. The user feels a slight jerk, and has a strong sense of operation. When the second adjusting member 2 is moved to the position desired by the user, the first elastic protruding portion 11 is fitted with the corresponding first buckle 21 to achieve the fixation of the second adjusting member 2, thereby facilitating adjustment to the sealing length of the sealing device 20, and simplifying the operation.

Figure 6:
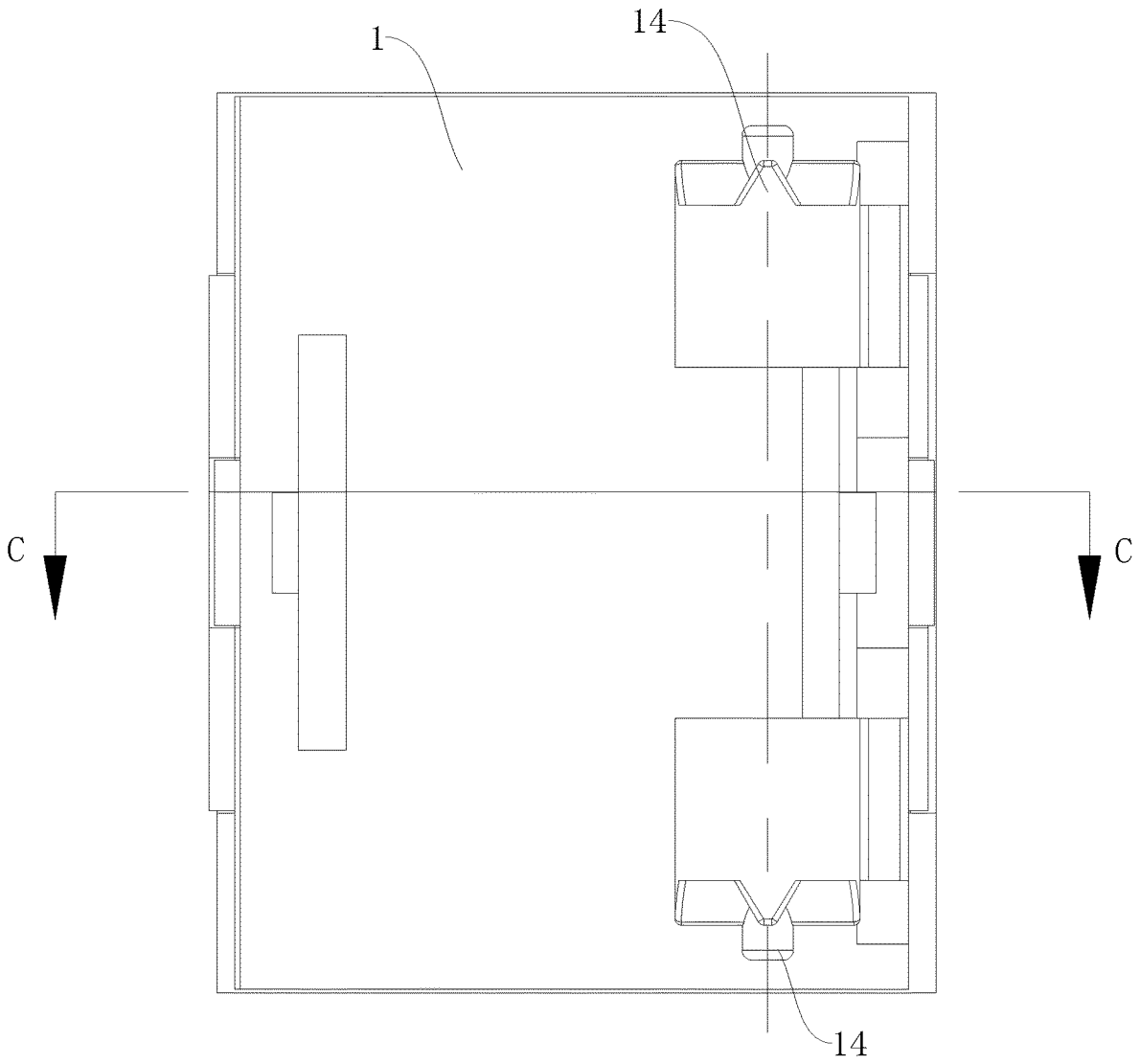
FIG. 6 is a plan view of FIG. 5.

In some embodiments of the present disclosure, the sealing device 20 further includes a third adjusting member 3, the third adjusting member 3 includes a second sliding space 3*a* therein, and the second adjusting member 2 is slidable relative to the third adjusting member 3 and extends into the second sliding space 3*a*. One of an inner wall of the third adjusting member 3 and an outer peripheral wall of the second adjusting member 2 is provided with a second elastic protruding portion 22, and the other one of the inner wall of the third adjusting member 3 and the outer peripheral wall of the second adjusting member 2 is provided with a plurality of second buckles 31. In other words, as shown in FIG. 6 and FIG. 7, the outer peripheral wall of the second adjusting member 2 is provided with the second elastic protruding portion 22, while the inner wall of the third adjusting member 3 is provided with the plurality of second buckles 31; or as shown in FIG. 8, the inner wall of the third adjusting member 3 is provided with the second elastic protruding portion 22, while the outer peripheral wall of the second adjusting member 2 is provided with the plurality of second buckles 31.

Referring to FIG. 7, the plurality of second buckles 31 are spaced apart along a sliding direction of the third adjusting member 3, and during the relative movement of the third adjusting member 3 and the second adjusting member 2, the second elastic protruding portion 22 is in switchable contact fit with the plurality of second buckles 31. It could be understood that when the user pulls the third adjusting member 3, the third adjusting member 3 can slide relative to the second adjusting member 2, and the second adjusting member 2 can slide relative to the first adjusting member 1, thereby increasing an adjustment range of the sealing length of the sealing device 20. Meanwhile, when the third adjusting member 3 slides relative to the second adjusting member 2, and the second adjusting member 2 slides relative to the first adjusting member 1, the user feels a slight jerk and has a strong sense of operation. Moreover, when the third adjusting member 3 and the second adjusting member 2 are moved to positions desired by the user, the second elastic protruding portion 22 is fitted with the corresponding second buckle 31 to achieve fixation of the third adjusting member 3, and the first elastic protruding portion 11 is fitted with the corresponding first buckle 21 to realize the fixation of the second adjusting member 2, in which case the operation is simple.

Figure 10:
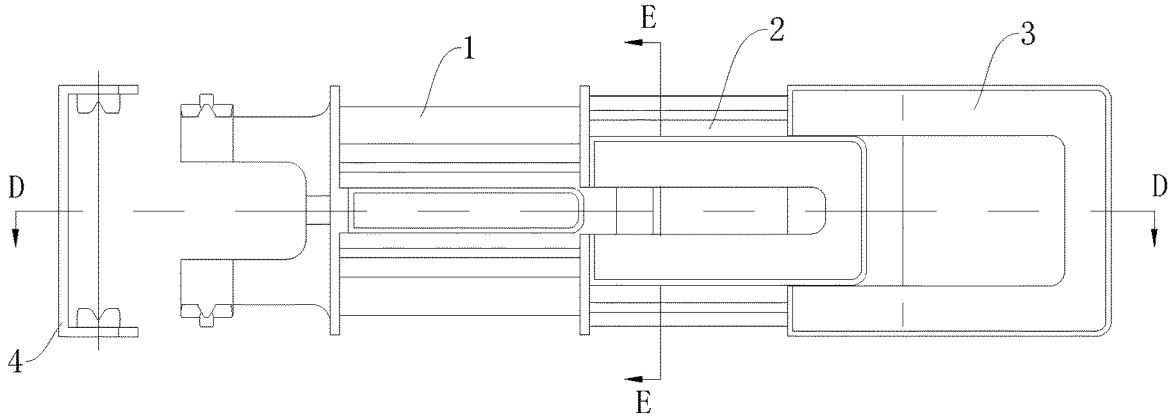
FIG. 10 is a front view of FIG. 9.

For instance in some examples, referring to FIG. 10, the sealing device 20 includes the first adjusting member 1, the second adjusting member 2, and the third adjusting member 3, the second adjusting member 2 is slidable relative to the first adjusting member 1, the third adjusting member 3 is slidable relative to the second adjusting member 2, and the first adjusting member 1 is connected to the casing 10. Certainly, the present disclosure is not limited thereto, and the third adjusting member 3 may be connected to the casing 10.

In some examples, referring to FIGS. 7 and 8, the plurality of first buckles 21 and the plurality of second buckles 31 are each formed in a rack shape.

In some embodiments of the present disclosure, referring to FIG. 7, the plurality of first buckles 21 and the second elastic protruding portion 22 are all disposed at the second adjusting member 2. Thus, the structure is simple and it is advantageous in reducing the production cost. For example, as shown in FIG. 7, the outer peripheral wall of the first adjusting member 1 is provided with the first elastic protruding portion 11, the inner wall of the second adjusting member 2 is provided with the plurality of first buckles 21, the outer peripheral wall of the second adjusting member 2 is provided with the second elastic protruding portion 22, and the inner wall of the third adjusting member 3 is provided with the second buckles 31.

Certainly, the present disclosure is not limited thereto. As shown in FIG. 8, the outer peripheral wall of the first adjusting member 1 is provided with the plurality of first buckles 21, the inner wall of the second adjusting member 2 is provided with the first elastic protruding portion 11, the outer peripheral wall of the second adjusting member 2 is provided with the plurality of second buckles 31, and the inner wall of the third adjusting member 3 is provided with the second elastic protruding portion 22.

In some optional embodiments of the present disclosure, referring to FIG. 3 and FIG. 7, the outer peripheral wall of the second adjusting member 2 is provided with a first recess 23, and the second elastic protruding portion 22 is disposed in the first recess 23. Thus, by disposing the second elastic protruding portion 22 in the first recess 23, the arrangement of the second elastic protruding portion 22 is facilitated, and at the same time, the structure between the second adjusting member 2 and the third adjusting member 3 becomes compact, which is advantageous in reducing a spaced occupied by the sealing device 20, and achieves the structural optimization of the sealing device 20.

In some embodiments of the present disclosure, referring to FIG. 3 and FIG. 7, a part of the second adjusting member 2 is recessed towards the first adjusting member 1 to form the first recess 23, and the second elastic protruding portion 22 is disposed at a bottom wall of the part of the second adjusting member 2. Thus, the production and formation of the first recess 23 is facilitated, and at the same time, the second elastic protruding portion 22 can be in switchable contact fit with the plurality of second buckles 31 conveniently.

In some embodiments of the present disclosure, referring to FIG. 3 and FIG. 7, the outer peripheral wall of the first adjusting member 1 is provided with a second recess 12, and the first elastic protruding portion 11 is disposed in the second recess 12. Thus, by disposing the first elastic protruding portion 11 in the second recess 12, it is advantageous in simplifying the structure of the sealing device 20, and at the same time, the structure between the first adjusting member 1 and the second adjusting member 2 becomes compact, thereby reducing the spaced occupied by the sealing device 20, and achieving the structural optimization of the sealing device 20.

In some embodiments of the present disclosure, referring to FIG. 3, a part of the first adjusting member 1 is recessed inwards to form the second recess 12, and the first elastic protruding portion 11 is disposed at a bottom wall of the part of the first adjusting member 1. Thus, the production and formation of the second recess 12 is facilitated, and at the same time, the first elastic protruding portion 11 can be in switchable contact fit with the plurality of first buckles 21 conveniently.

In some embodiments of the present disclosure, referring to FIG. 3, the inner wall of the third adjusting member 3 is provided with an insert 32 that projects into the second adjusting member 2 and the first adjusting member 1. For example, as shown in FIG. 7, the insert 32 is a cantilever plate extending from a bottom wall of the third adjusting member 3, and the insert 32 has a first end connected to an inner side wall of the third adjusting member 3 facing the first adjusting member 1 and a second end projecting into the second adjusting member 2 and the first adjusting member 1. Therefore, during the movement of the third adjusting member 3 relative to the first adjusting member 1, the insert 32 can guide the movement of the third adjusting member 3, so that the user can pull the third adjusting member 3 conveniently to change the sealing length of the sealing device 20, and it is advantageous in ensuring that central axes of the first adjusting member 1 and the third adjusting member 3 are on the same straight line.

Figure 5:
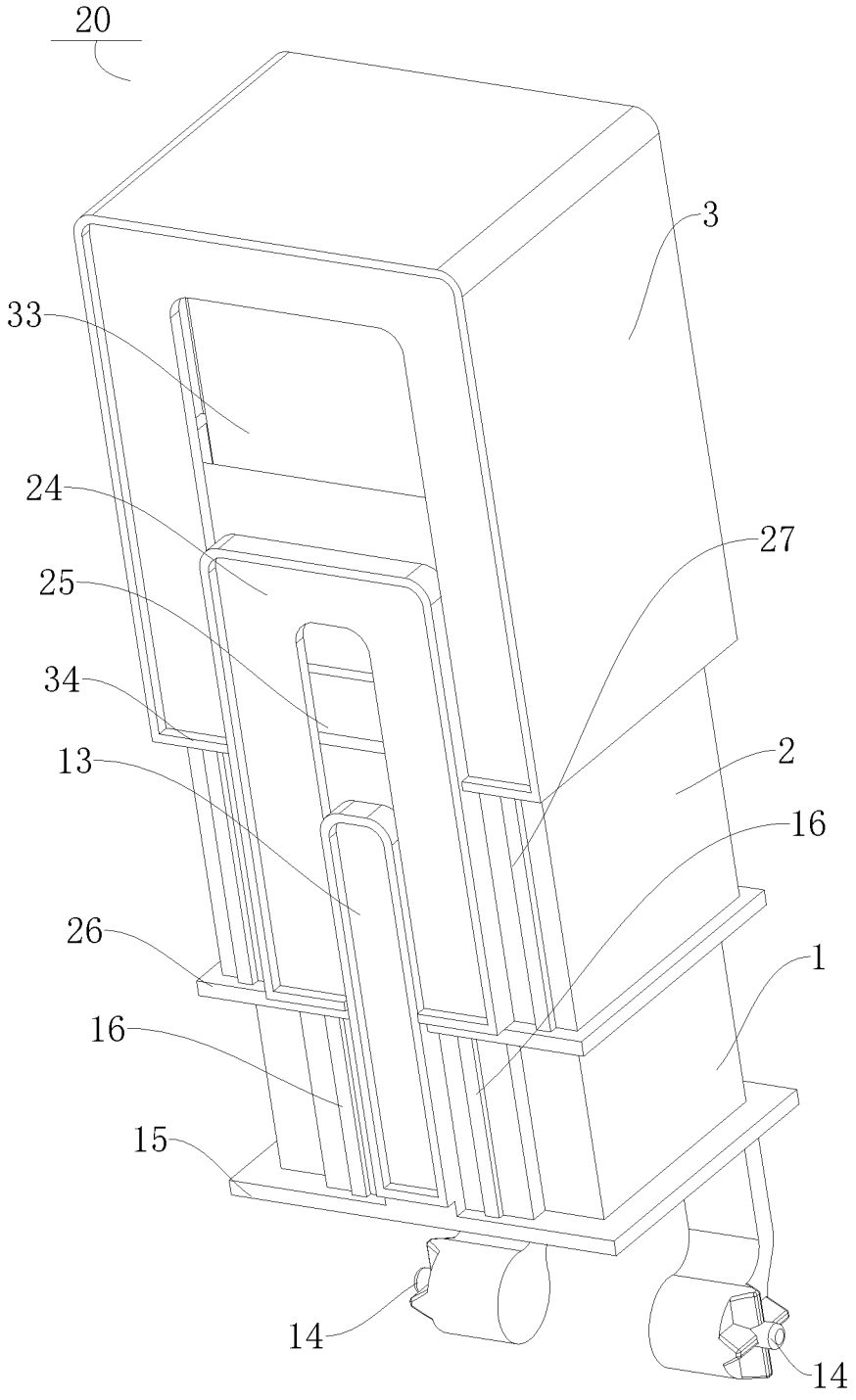
FIG. 5 is a perspective view of a sealing device for a window air conditioner according to embodiments of the present disclosure, in which state the sealing device has a maximum sealing length.

In some embodiments of the present disclosure, referring to FIG. 5, the third adjusting member 3 is provided with a first sliding groove 33 in a peripheral wall thereof, and the second adjusting member 2 is provided with a first sliding protrusion 24 fitted with the first sliding groove 33. Therefore, through the sliding fit between the first sliding groove 33 and the first sliding protrusion 24, the sliding of the third adjusting member 3 relative to the second adjusting member 2 can be guided, so that the user can pull the third adjusting member 3 conveniently to change the sealing length of the sealing device 20, and it is advantageous in ensuring that central axes of the second adjusting member 2 and the third adjusting member 3 are on the same straight line. For example, as shown in FIG. 5, the first sliding protrusion 24 is formed as a U-shaped protrusion, and the first sliding groove 33 is formed as a U-shaped groove.

In some embodiments of the present disclosure, referring to FIG. 5, the second adjusting member 2 is provided with a second sliding groove 25 in a peripheral wall thereof, and the first adjusting member 1 is provided with a second sliding protrusion 13 fitted with the second sliding groove 25. Therefore, through the sliding fit between the second sliding groove 25 and the second sliding protrusion 13, the sliding of the second adjusting member 2 relative to the first adjusting member 1 can be guided, so that the user can pull the second adjusting member 2 conveniently to change the sealing length of the sealing device 20, and it is advantageous in ensuring that central axes of the first adjusting member 1 and the second adjusting member 2 are on the same straight line. For example, as shown in FIG. 5, the second sliding protrusion 13 is formed as a U-shaped protrusion, and the second sliding groove 25 is formed as a U-shaped groove.

In some embodiments of the present disclosure, referring to FIG. 5, the first sliding groove 33 penetrates the third adjusting member 3 in a thickness direction, the second sliding groove 25 penetrates the second adjusting member 2 in the thickness direction, and the first sliding protrusion 24 is disposed around the second sliding groove 25. For example, as shown in FIG. 5, the second sliding groove 25 is disposed in the first sliding protrusion 24, and the second sliding groove 25 penetrates the first sliding protrusion 24 in a thickness direction of the first sliding protrusion 24 and extends in a length direction of the first sliding protrusion 24. Thus, the structure is simple, and when the user adjusts the sealing length of the sealing device 20, the cooperation between the first adjusting member 1 and the second adjusting member 2 and between the third adjusting member 3 and the second adjusting member 2 can be reliable.

In some embodiments of the present disclosure, referring to FIG. 3, the third adjusting member 3 is provided with a third sliding groove 35 on a peripheral wall thereof, and the second adjusting member 2 is provided with a third sliding protrusion 27 fitted with the third sliding groove 35. Thus, through the sliding fit between the third sliding groove 35 and the third sliding protrusion 27, the sliding of the third adjusting member 3 relative to the second adjusting member 2 can be guided, so that the user can pull the third adjusting member 3 conveniently to change the sealing length of the sealing device 20, and it is advantageous in ensuring that central axes of the second adjusting member 2 and the third adjusting member 3 are on the same straight line.

For example, as shown in FIG. 3, an inner peripheral wall of the third adjusting member 3 is provided with a plurality of third sliding grooves 35, the outer peripheral wall of the second adjusting member 2 is provided with a plurality of third sliding protrusions 27, and the plurality of third sliding protrusions 27 are fitted with the plurality of third sliding grooves 35 in one-to-one correspondence.

Figure 12:
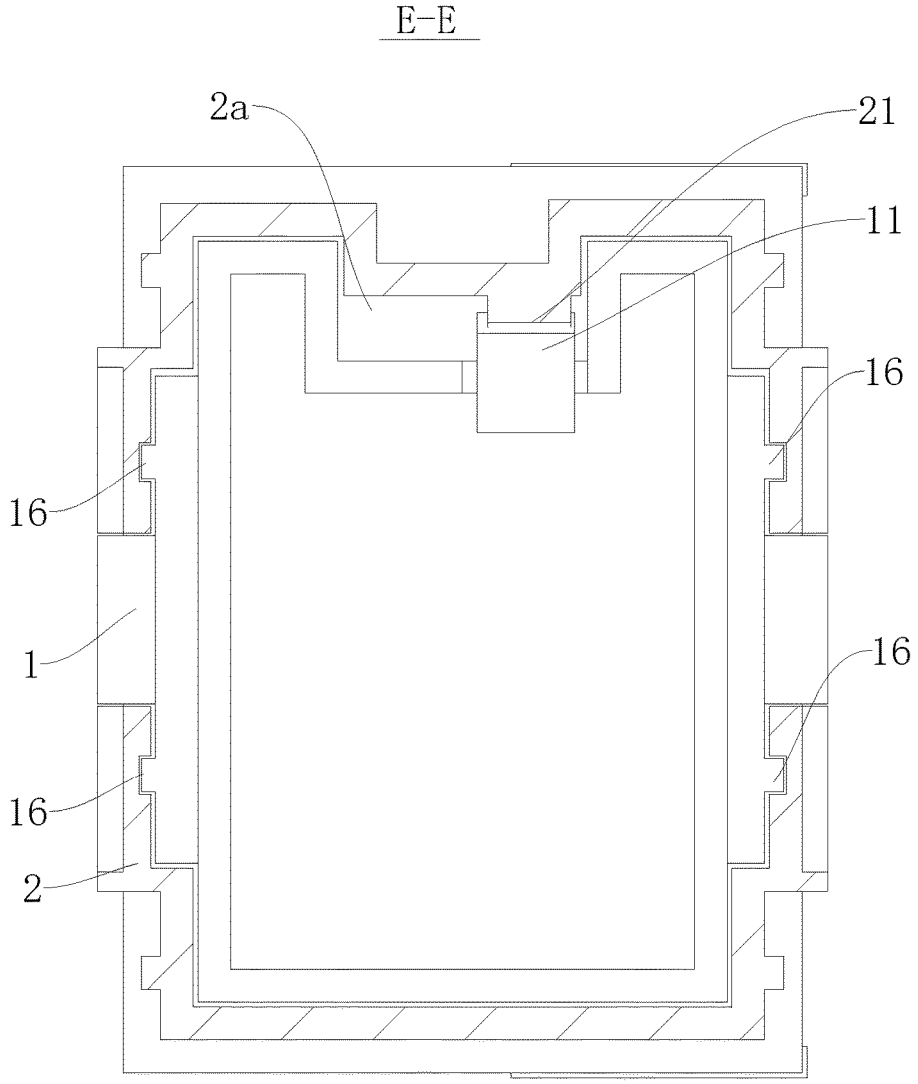
FIG. 12 is a sectional view taken along line E-E in FIG. 10.

In some embodiments of the present disclosure, referring to FIG. 3, a peripheral wall of the second adjusting member 2 is provided with a fourth sliding groove 28, and the first adjusting member 1 is provided with a fourth sliding protrusion 16 (referring to FIG. 12) fitted with the fourth sliding groove 28. Therefore, through the sliding fit between the fourth sliding groove 28 and the fourth sliding protrusion 16, the sliding of the second adjusting member 2 relative to the first adjusting member 1 can be adjusted, so that the user can pull the second adjusting member 2 conveniently to change the sealing length of the sealing device 20, and it is advantageous in ensuring that central axes of the first adjusting member 1 and the second adjusting member 2 are on the same straight line.

For example, as shown in FIG. 3, an inner peripheral wall of the second adjusting member 2 is provided with a plurality of fourth sliding grooves 28, the outer peripheral wall of the first adjusting member 1 is provided with a plurality of fourth sliding protrusions 16, and the plurality of fourth sliding protrusions 16 are fitted with the plurality of fourth sliding grooves 28 in one-to-one correspondence.

In some embodiments of the present disclosure, referring to FIG. 3, the third sliding groove 35 penetrates the third adjusting member 3 in a moving direction of the third adjusting member 3, and the fourth sliding groove 28 penetrates the second adjusting member 2 in the moving direction of the second adjusting member 2. Therefore, it is advantageous in enlarging a fitting area between the third sliding groove 35 and the third sliding protrusion 27, and a fitting area between the fourth sliding groove 28 and the fourth sliding protrusion 27, so as to ensure the reliability of the cooperation between the first adjusting member 1 and the second adjusting member 2 and between the third adjusting member 3 and the second adjusting member 2 when adjusting the sealing length of the sealing device 20.

For example, as shown in FIG. 3, four third sliding protrusions 27 and four fourth sliding grooves 28 are provided, wherein two third sliding protrusions 27 are located above the four fourth sliding grooves 28, and the remaining two third sliding protrusions 27 are located below the four fourth sliding grooves 28.

Specifically, the sealing device 20 may be a material piece, such as plastics, plates, rubber, or silica gel.

Additionally, in some examples, as shown in FIG. 5, an annular first abutting portion 15 is provided at an outer peripheral wall of an end of the first adjusting member 1 in a direction of the sealing length, and a second abutting portion 26 is provided at the second adjusting member 2, in which the second abutting portion 26 is adapted to abut against the first abutting portion 15. A third abutting portion 34 is provided at the outer peripheral wall of the third adjusting member 3, and the third abutting portion 34 is adapted to abut against the second abutting portion 26. When the sealing device 20 has a minimum sealing length, one side surface of the second abutting portion 26 abuts against the first abutting portion 15, and the opposite side surface of the second abutting portion 26 abuts against the third abutting portion 34. Therefore, when the sealing device 20 has the minimum sealing length, by allowing one side surface of the second abutting portion 26 to abut against the first abutting portion 15, and the opposite side surface of the second abutting portion 26 to abut against the third abutting portion 34, the sealing device 20 can be prevented from being deformed in the direction of the sealing length, and the structure is simple and easy to process and form.

In some embodiments of the present disclosure, referring to FIG. 5 and FIG. 6, the central axes of the first adjusting member 1, the second adjusting member 2, and the third adjusting member 3 are on the same straight line, and outer contours of respective projections of the first abutting portion 15, the second abutting portion 26, and the third abutting portion 34 projected on a plane perpendicular to the straight line coincide. Thus, the structure of the sealing device 20 is simple, and sealing sponges are easily affixed among the first adjusting member 1, the second adjusting member 2, and the third adjusting member 3.

Figure 4:
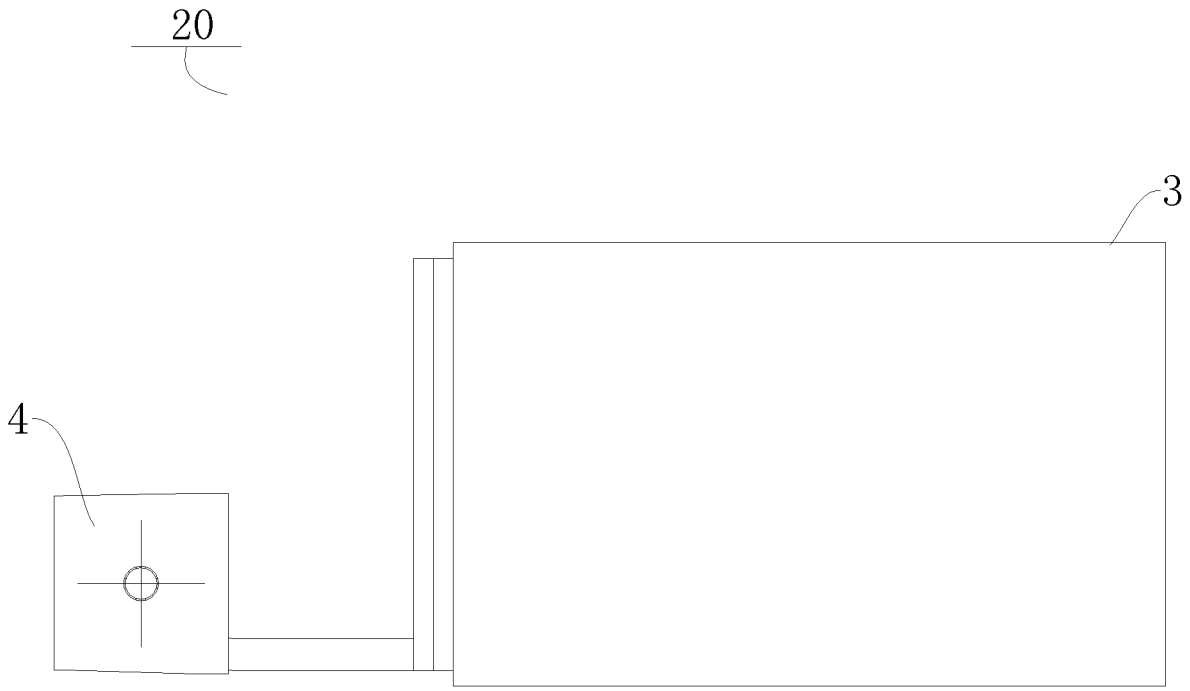
FIG. 4 is a bottom view of FIG. 1.
Figure 9:
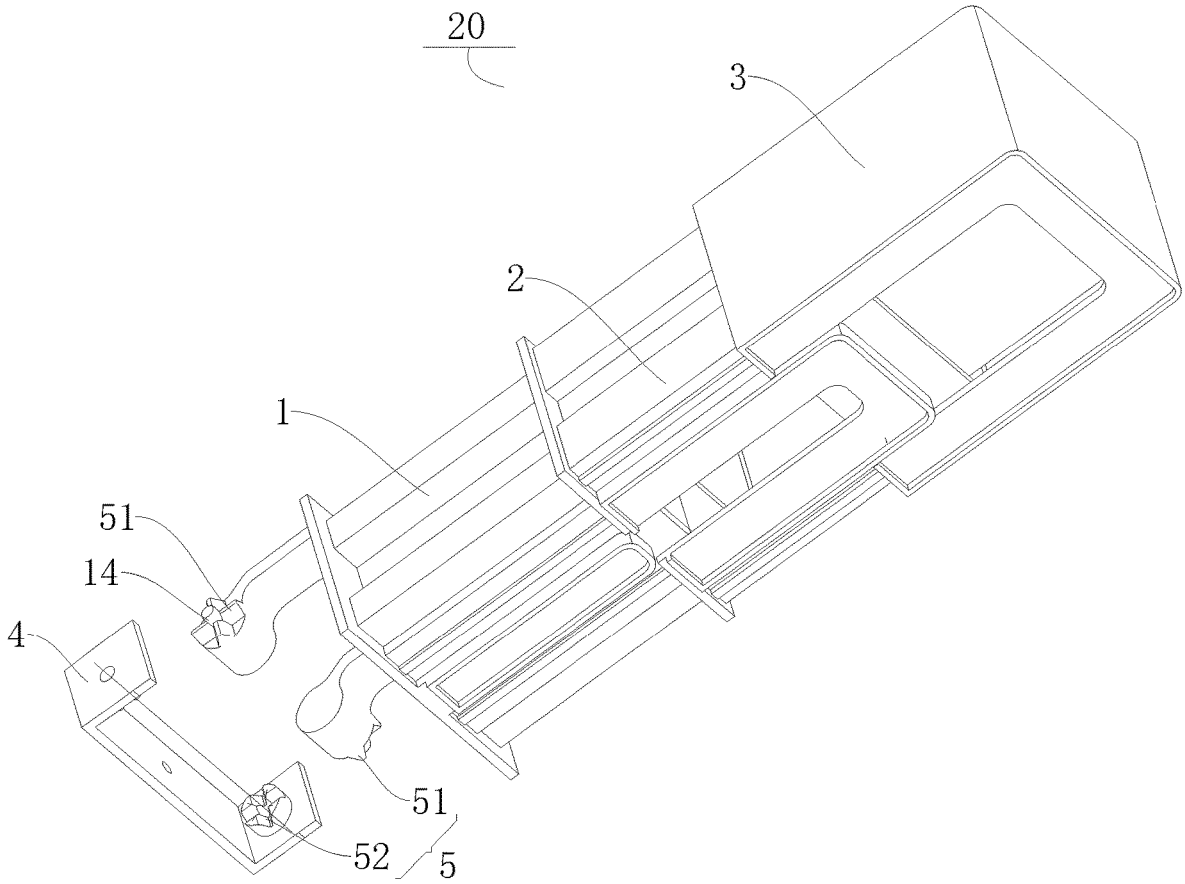
FIG. 9 is a schematic view of a sealing device for a window air conditioner from another angle of view according to embodiments of the present disclosure.

In some embodiments of the present disclosure, referring to FIG. 9 and FIG. 10, the sealing device 20 further includes a rotating bracket 4 (referring to FIG. 4), the rotating bracket is fixed at the casing 10, and the first adjusting member 1 is rotatably provided at the rotating bracket 4. In this way, not only the installation of the first adjusting member 1 is facilitated, but also the first adjusting member 1 is allowed to rotate relative to the rotating bracket 4 to facilitate storage of the sealing device 20, which is advantageous in reducing the space occupied by the sealing device 20.

In some embodiments of the present disclosure, referring to FIG. 9 and FIG. 10, the first adjusting member 1 is provided with a pivot shaft 14, the rotating bracket 4 is provided with a pivot hole 41, and the pivot shaft 14 is rotatably fitted with the pivot hole 41. Thus, the smooth rotation of the first adjusting member 1 is facilitated, and the rotation reliability of the first adjusting member 1 is enhanced.

In some embodiments of the present disclosure, as shown in FIG. 9, the sealing device 20 further includes an angle positioning assembly 5, and the angle positioning assembly 5 cooperates with the rotating bracket 4 and the first adjusting member 1 to position the first adjusting member 1 when the first adjusting member 1 is rotated to a set angle. In this way, the first adjusting member 1 can be positioned at a specific angle, and for example, an angle between the first adjusting member 1 and the horizontal direction is 30°, 45° or 90°, so that the user can position a rotation angle of the first adjusting member 1 according to requirements, thereby improving the performance of the sealing device 20.

Figure 11:
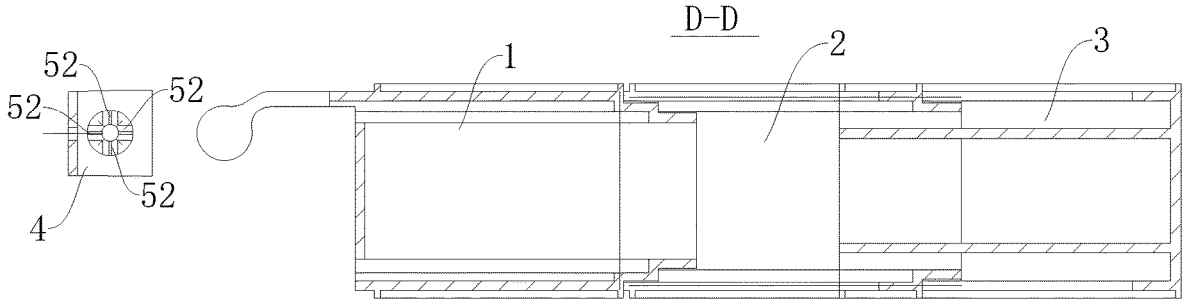
FIG. 11 is a sectional view taken along line D-D in FIG. 10.
Figure 13:
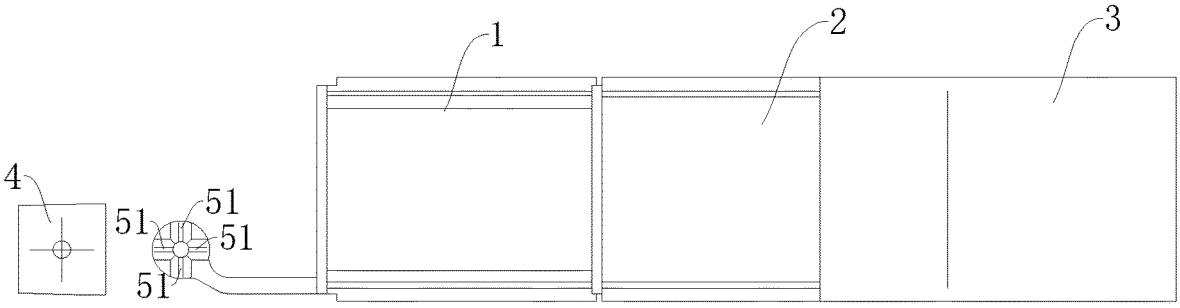
FIG. 13 is a bottom view of FIG. 10.

In some embodiments of the present disclosure, as shown in FIG. 11 and FIG. 13, the angle positioning assembly 5 includes a positioning protrusion 51 and a plurality of positioning recesses 52. The positioning protrusion 51 is provided on the first adjusting member 1, the plurality of positioning recesses 52 are provided in the rotating bracket 4 and arranged in a circular shape. When the first adjusting member 1 rotates, the positioning protrusion 51 can be switchably fitted with the plurality of positioning recesses 52, and the first adjusting member 1 is positioned when the positioning protrusion 51 is fitted with one of the positioning recesses 52. In this way, the rotation angle of the first adjusting member 1 can be positioned by using the positioning protrusion 51 and the positioning recesses 52, thereby improving the reliability and stability of the positioning of the first adjusting member 1 by the rotating bracket 4.

The window air conditioner 100 according to embodiments of the present disclosure will be described below.

Figure 14:
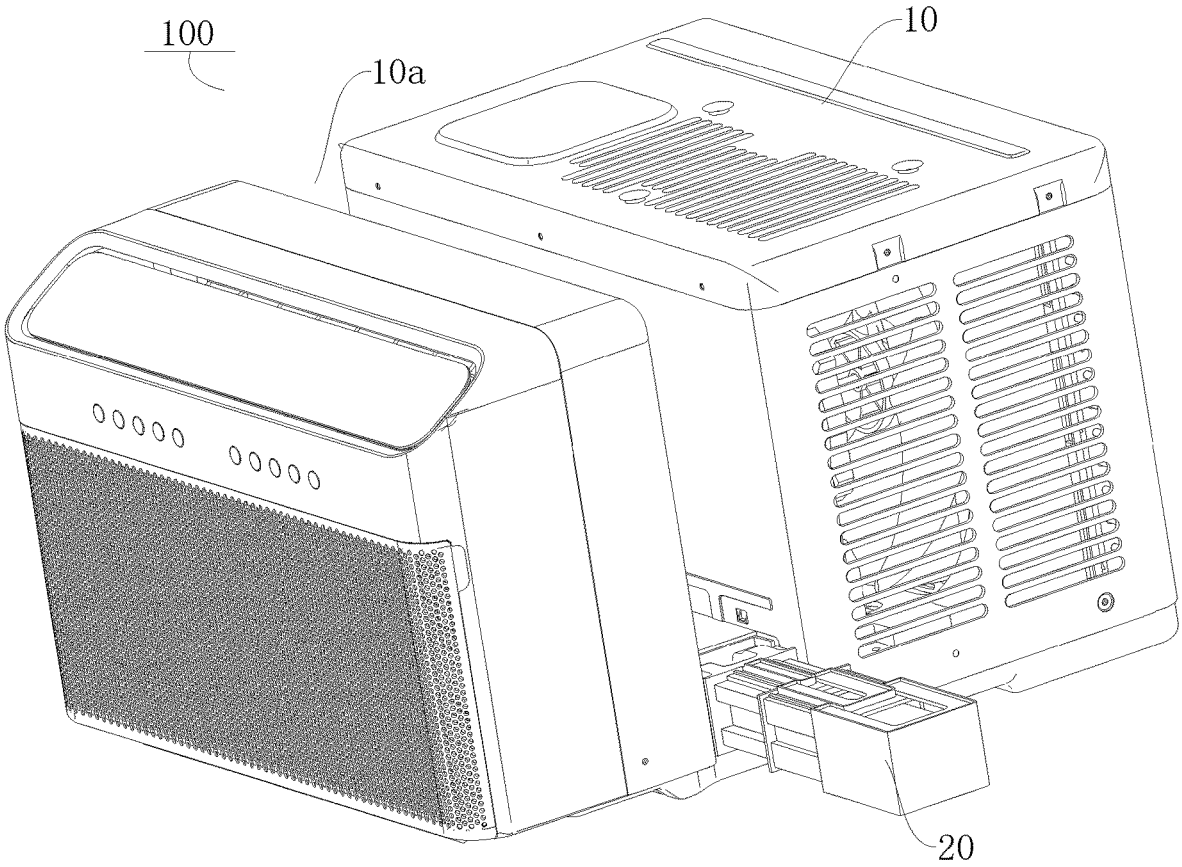
FIG. 14 is a schematic view of a window air conditioner according to embodiments of the present disclosure, in which a sealing device is in a sealing position.
Figure 18:
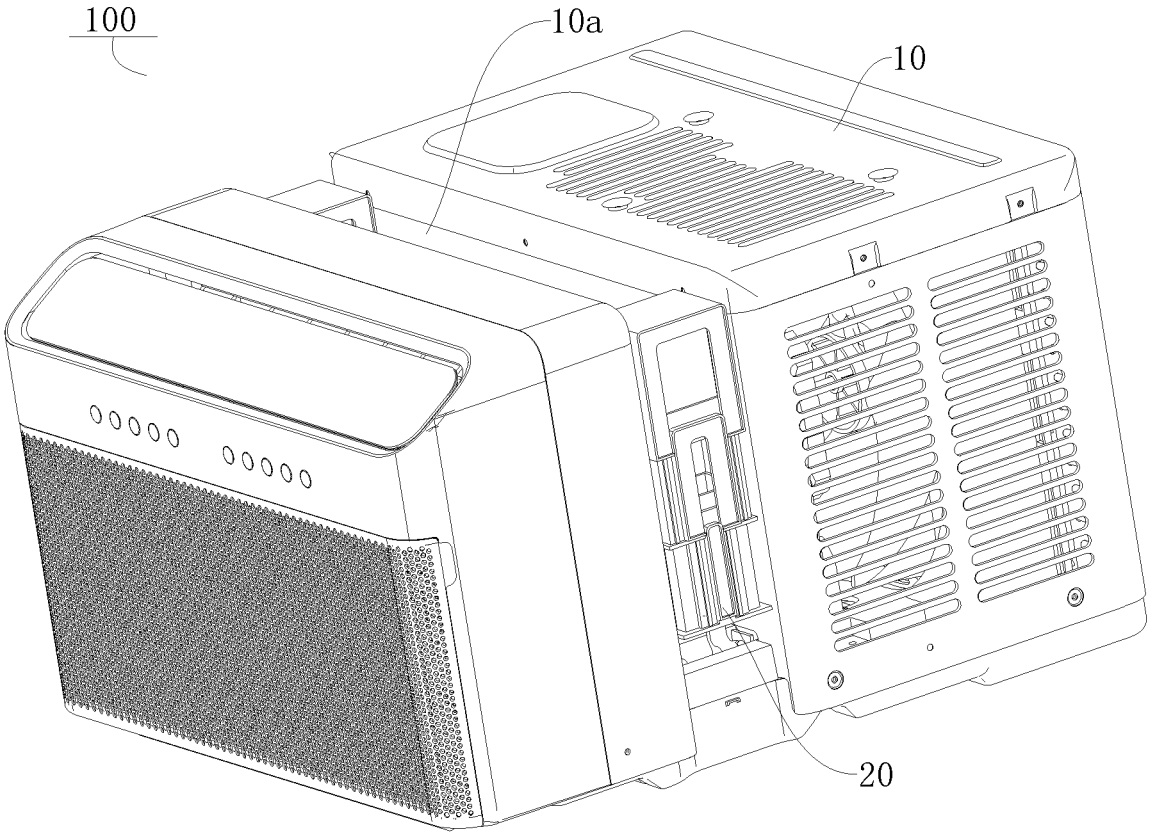
FIG. 18 is a schematic view of a window air conditioner according to embodiments of the present disclosure, in which a sealing device is in a stored position.

Referring to FIGS. 14 and 18, the window air conditioner 100 according to the second aspect of the present disclosure is supported in a window opening of a wall, and a movable window sash is provided in the window opening. The window air conditioner 100 includes a casing 10 and a sealing device 20. The casing 10 is provided with a receiving groove 10*a*, and at least a part of the window sash can protrude into the receiving groove 10*a*. The sealing device 20 is the sealing device 20 according to the above embodiments of the present disclosure, and the sealing device 20 is in contact with a bottom end of the window sash, a bottom wall of the window opening, and a side wall of the window opening separately.

Figure 15:
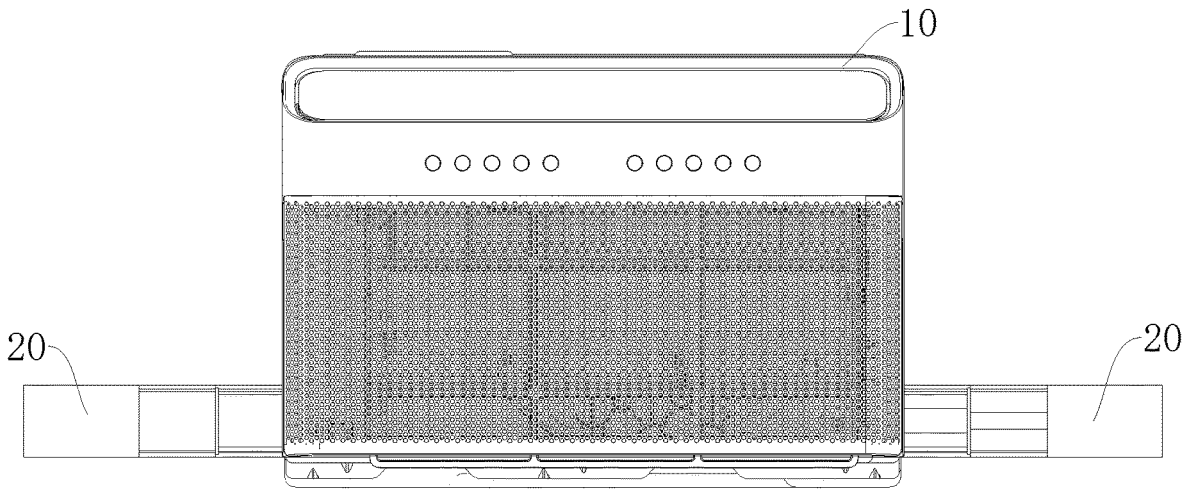
FIG. 15 is a front view of FIG. 14.
Figure 16:
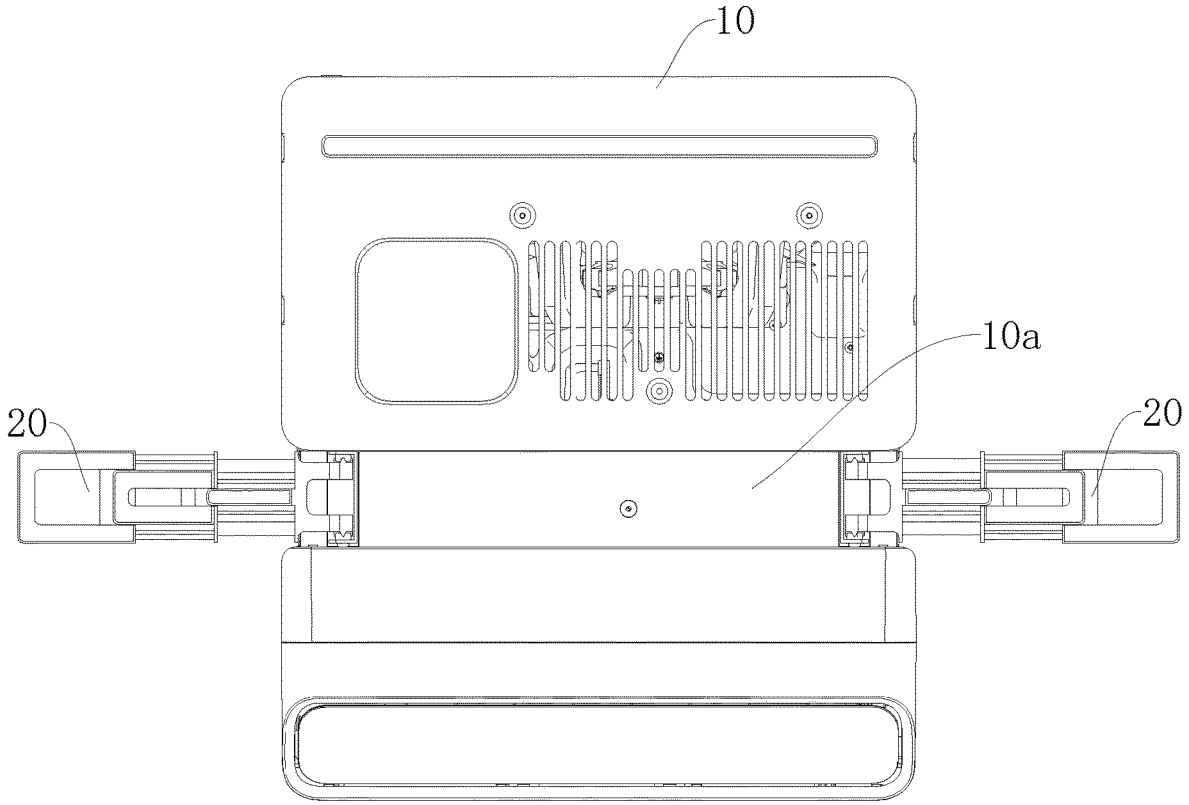
FIG. 16 is a bottom view of FIG. 15.
Figure 17:
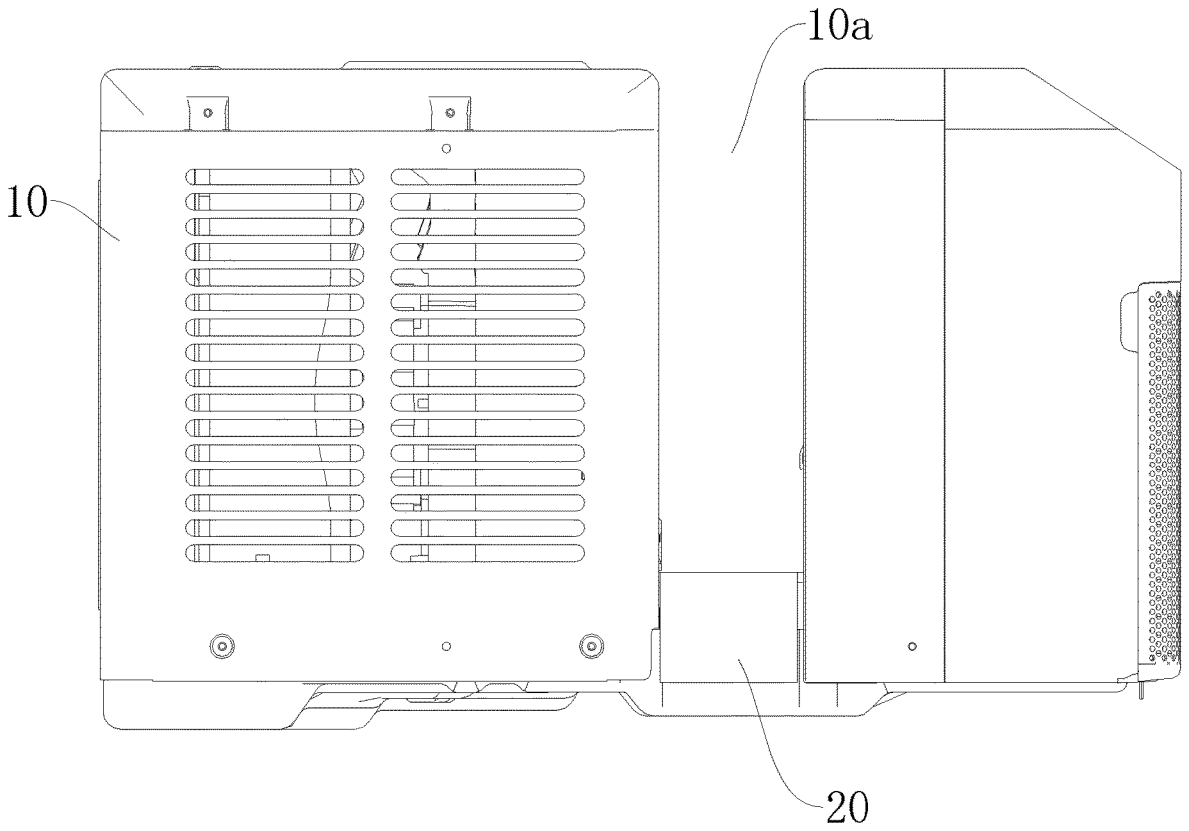
FIG. 17 is a left view of FIG. 15.
Figure 19:
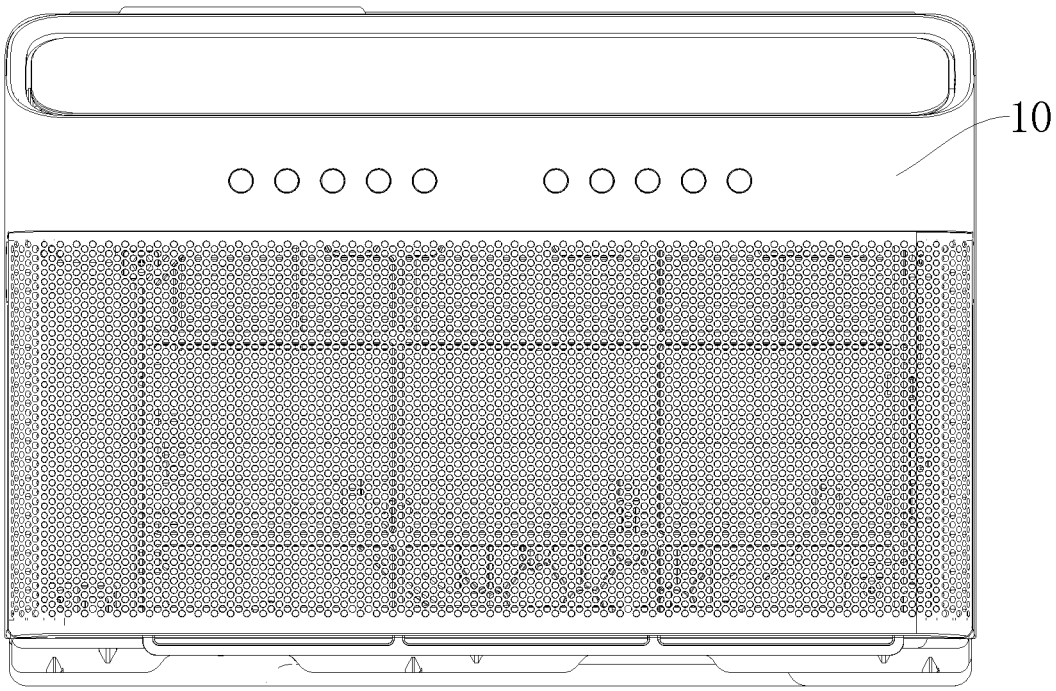
FIG. 19 is a front view of FIG. 18.
Figure 20:
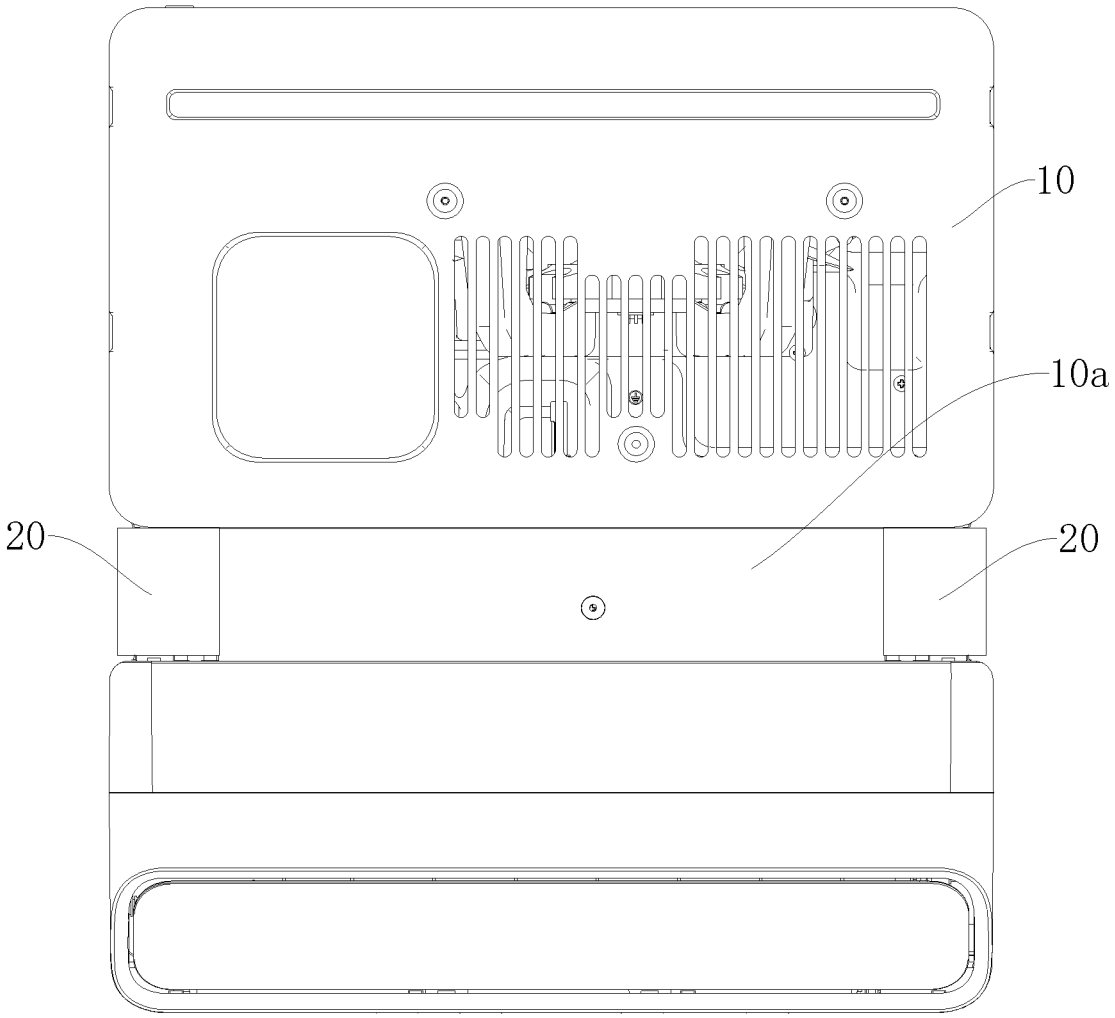
FIG. 20 is a bottom view of FIG. 19.
Figure 21:
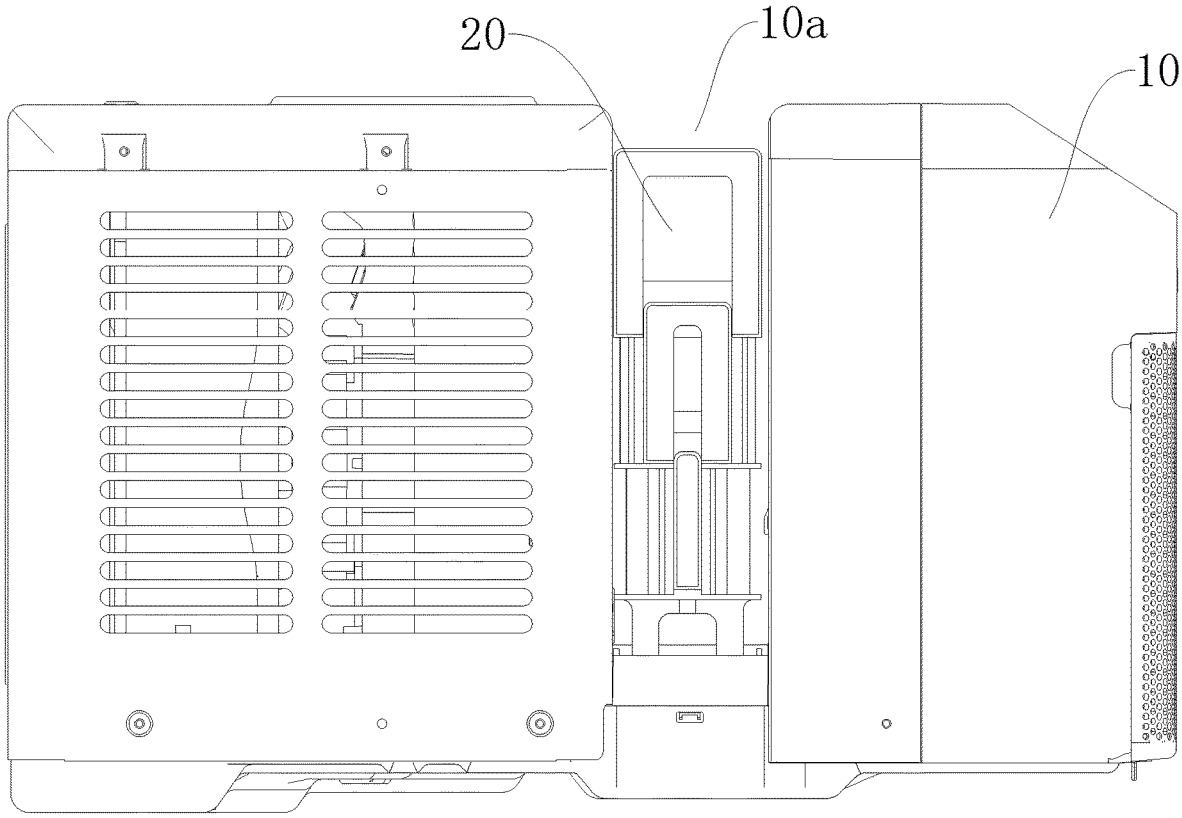
FIG. 21 is a left view of FIG. 19.

For example, when the window air conditioner 100 is transported, the window air conditioner 100 can be in a stored position as shown in FIGS. 19-21, that is, the sealing device 20 is received in the receiving groove 10*a*. When the window air conditioner 100 is in a sealed position, as shown in FIGS. 15-17, the sealing device 20 is rotated to extend out of a machine body of the window air conditioner 100. A bottom wall of the sealing device 20 can be in contact with the bottom wall of the window opening, a side wall of the sealing device 20 can be in contact fit with the side wall of the window opening, and a top wall of the sealing device 20 can be in contact fit with the window sash.

For the window air conditioner 100 according to the embodiments of the present disclosure, by providing the sealing device 20 according to the above-described embodiments of the present disclosure, the user can directly pull the second adjusting member 2 to adjust the sealing length of the sealing device 20. Meanwhile, during the movement of the second adjusting member 2, the first elastic protruding portion 11 is in switchable contact fit with the plurality of first buckles 21, in which case the user feels a slight jerk and has a strong sense of operation. When the second adjusting member 2 is moved to a position desired by the user, the first elastic protruding portion 11 is fitted with the corresponding first buckle 21 to achieve fixation of the second adjusting member 2, thereby facilitating adjustment to the sealing length of the sealing device 20, and simplifying the operation, so as to improve the user experience.

Other configurations and operations of the window air conditioner 100 according to embodiments of the present disclosure are known to those skilled in the art and will not described herein.

In the specification, it is to be understood that terms such as "central," "length," "width," "thickness," "upper," "lower," "front," "rear," "left," "right," "vertical," "horizontal," "top," "bottom," "inner," "outer," "axial," "radial," and "circumferential" should be construed to refer to the orientation as then described or as shown in the drawings under discussion. These relative terms are for convenience of description and do not indicate or imply that the device or element referred to must have a particular orientation, or be constructed and operated in a particular orientation. Thus, these terms shall not be construed to limit the present disclosure.

In addition, terms such as "first" and "second" are used herein for purposes of description and are not intended to indicate or imply relative importance or significance. Thus, the feature associated with "first" and "second" may comprise one or more this feature. In the description of the present disclosure, the term "a plurality of" means two or more than two, unless specified otherwise.

In the present disclosure, unless specified or limited otherwise, it should be understood that the terms "mounted," "connected," "coupled," "fixed" and the like are used broadly, and may be, for example, fixed connections, detachable connections, or integral connections; may also be mechanical or electrical connections; may also communicate with each other; may also be direct connections or indirect connections via intervening structures; may also be inner communications or mutual interaction of two elements, which could be understood by those skilled in the art according to specific situations.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples. In addition, different embodiments or examples as well as features in different embodiments or examples described herein can be combined without any contradiction.

Although embodiments of the present disclosure have been shown and described, it would be appreciated by those skilled in the art that changes, modifications, alternatives and variations can be made in the embodiments without departing from the scope of the present disclosure. The scope of the invention is defined by the claims and the like.

What is claimed is:

1. A sealing device for a window air conditioner comprising:

a first adjusting member; and a second adjusting member including a sliding space;

wherein:

the first adjusting member extends into the sliding space;

the second adjusting member is slidable relative to the first adjusting member;

one of an outer peripheral wall of the first adjusting member and an inner wall of the second adjusting member includes a plurality of buckles spaced apart from one another along a moving direction of the second adjusting member;

another one of the outer peripheral wall of the first adjusting member and the inner wall of the second adjusting member includes an elastic protruding portion in switchable contact fit with the plurality of buckles during movement of the second adjusting member;

the window air conditioner is configured to be installed in a window opening of a wall with a movable window sash provided in the window opening, the sealing device is configured to be provided corresponding to a receiving groove of a casing of the window air conditioner, one end of the sealing device is configured to be connected to the casing, and another end of the sealing device is configured to seal, at an outer side of the casing, a gap between the window opening and the window sash; and the sealing device further comprising a rotating bracket configured to be fixed at a casing of the window air conditioner, the first adjusting member being rotatably coupled to the rotating bracket.

2. The sealing device according to claim 1, further comprising:

an angle positioning assembly configured to cooperate with the rotating bracket and the first adjusting member to position the first adjusting member at a set angle.

3. The sealing device according to claim 2, wherein the angle positioning assembly comprises:

a plurality of positioning recesses provided in the rotating bracket and arranged in a circular shape; and a positioning protrusion configured to be switchably fitted with one of the plurality of positioning recesses when the first adjusting member rotates.

4. The sealing device according to claim 1, wherein the sliding space is a first sliding space, the elastic protruding portion is a first elastic protruding portion, and the plurality of buckles are a plurality of first buckles;

the sealing device further comprising:

a third adjusting member including a second sliding space;

wherein:

the second adjusting member is slidable relative to the third adjusting member and extends into the second sliding space;

one of an inner wall of the third adjusting member and an outer peripheral wall of the second adjusting member includes a plurality of second buckles spaced apart from one another along a sliding direction of the third adjusting member; and another one of the inner wall of the third adjusting member and the outer peripheral wall of the second adjusting member includes a second elastic protruding portion in switchable contact fit with the plurality of second buckles during a relative movement of the third adjusting member and the second adjusting member.

5. The sealing device according to claim 4, wherein the inner wall of the third adjusting member includes an insert that projects into the second adjusting member and the first adjusting member.

6. The sealing device according to claim 4, wherein the third adjusting member includes a sliding groove in a peripheral wall of the third adjusting member, and the second adjusting member includes a sliding protrusion fitted with the sliding groove.

7. The sealing device according to claim 6, wherein:

the sliding groove is a first sliding groove and the sliding protrusion is a first sliding protrusion;

the second adjusting member includes a second sliding groove in a peripheral wall of the second adjusting member; and the first adjusting member includes a second sliding protrusion fitted with the second sliding groove.

8. The sealing device according to claim 7, wherein the first sliding groove penetrates the third adjusting member in a thickness direction of the third adjusting member, the second sliding groove penetrates the second adjusting member in a thickness direction of the second adjusting member, and the first sliding protrusion is disposed around the second sliding groove.

9. The sealing device according to claim 4, wherein the plurality of first buckles and the second elastic protruding portion are provided at the second adjusting member.

10. The sealing device according to claim 9, wherein the outer peripheral wall of the second adjusting member includes a recess, and the second elastic protruding portion is provided in the recess.

11. The sealing device according to claim 10, wherein the recess includes a part of the second adjusting member recessed towards the first adjusting member, and the second elastic protruding portion is provided at a bottom wall of the part of the second adjusting member.

12. The sealing device according to claim 9, wherein the outer peripheral wall of the first adjusting member includes a recess, and the first elastic protruding portion is provided in the recess.

13. The sealing device according to claim 12, wherein the recess includes a part of the first adjusting member recessed inwards.

14. A window air conditioner comprising:

a casing including a receiving groove dividing the casing into two parts; and a sealing device provided corresponding to the receiving groove, coupled to an inner side wall of the receiving groove, and including:

a first adjusting member; and a second adjusting member including a sliding space;

wherein:

the first adjusting member extends into the sliding space;

the second adjusting member is slidable relative to the first adjusting member;

one of an outer peripheral wall of the first adjusting member and an inner wall of the second adjusting member includes a plurality of buckles spaced apart from one another along a moving direction of the second adjusting member;

another one of the outer peripheral wall of the first adjusting member and the inner wall of the sliding space second adjusting member includes an elastic protruding portion in switchable contact fit with the plurality of buckles during movement of the second adjusting member;

the window air conditioner is configured to be installed in a window opening of a wall with a movable window sash provided in the window opening, one end of the sealing device is connected to the casing, and another end of the sealing device is configured to seal, at an outer side of the casing, a gap between the window opening and the window sash; and wherein the sealing device further comprises a rotating bracket fixed at the casing, the first adjusting member being rotatably coupled to the rotating bracket.

15. The window air conditioner according to claim 14, wherein the sealing device further comprises:

an angle positioning assembly configured to cooperate with the rotating bracket and the first adjusting member to position the first adjusting member at a set angle.

16. The window air conditioner according to claim 14, wherein the sliding space is a first sliding space, the elastic protruding portion is a first elastic protruding portion, and the plurality of buckles are a plurality of first buckles;

the sealing device further comprising:

a third adjusting member including a second sliding space;

wherein:

the second adjusting member is slidable relative to the third adjusting member and extends into the second sliding space;

one of an inner wall of the third adjusting member and an outer peripheral wall of the second adjusting member includes a plurality of second buckles spaced apart from one another along a sliding direction of the third adjusting member; and another one of the inner wall of the third adjusting member and the outer peripheral wall of the second adjusting member includes a second elastic protruding portion in switchable contact fit with the plurality of second buckles during a relative movement of the third adjusting member and the second adjusting member.

17. The window air conditioner according to claim 16, wherein the inner wall of the third adjusting member includes an insert that projects into the second adjusting member and the first adjusting member.

18. A sealing device for a window air conditioner comprising:

a rotating bracket configured to be fixed at a casing of the window air conditioner;

a first adjusting member rotatably coupled to the rotating bracket; and a second adjusting member including a sliding space;

wherein:

the first adjusting member extends into the sliding space;

the second adjusting member is slidable relative to the first adjusting member;

one of an outer peripheral wall of the first adjusting member and an inner wall of the second adjusting member includes a plurality of buckles spaced apart from one another along a moving direction of the second adjusting member; and another one of the outer peripheral wall of the first adjusting member and the inner wall of the second adjusting member includes an elastic protruding portion in switchable contact fit with the plurality of buckles during movement of the second adjusting member.

* * * * *